US009979118B2

(12) United States Patent
Khadkikar et al.

(10) Patent No.: US 9,979,118 B2
(45) Date of Patent: May 22, 2018

(54) HIGH-PRESSURE HERMETIC TERMINAL

(71) Applicant: Emerson Electric Co., St. Louis, MO (US)

(72) Inventors: Prasad S. Khadkikar, Cincinnati, OH (US); Gabriel Lakner, Cincinnati, OH (US)

(73) Assignee: Emerson Electric Co., St. Louis, MO (US)

( * ) Notice: Subject to any disclaimer, the term of this patent is extended or adjusted under 35 U.S.C. 154(b) by 344 days.

(21) Appl. No.: 14/772,113

(22) PCT Filed: Oct. 14, 2013

(86) PCT No.: PCT/US2013/064788
§ 371 (c)(1),
(2) Date: Sep. 2, 2015

(87) PCT Pub. No.: WO2014/143179
PCT Pub. Date: Sep. 18, 2014

(65) Prior Publication Data

US 2016/0020547 A1 Jan. 21, 2016

Related U.S. Application Data

(60) Provisional application No. 61/788,762, filed on Mar. 15, 2013.

(51) Int. Cl.
*H01R 13/52* (2006.01)
*H01B 17/30* (2006.01)
(Continued)

(52) U.S. Cl.
CPC ..... *H01R 13/521* (2013.01); *F04B 39/121* (2013.01); *F04B 53/16* (2013.01); *H01B 17/303* (2013.01); *H01R 43/16* (2013.01)

(58) Field of Classification Search
USPC ..... 174/50.56
See application file for complete search history.

(56) References Cited

U.S. PATENT DOCUMENTS 2,429,955 A 10/1947 Goldsmith
4,362,792 A * 12/1982 Bowsky ..... H01M 2/065 174/152 GM (Continued)

FOREIGN PATENT DOCUMENTS

EP 2299118 3/2011
FR 1057611 3/1954

(Continued)

OTHER PUBLICATIONS

Extended European Search Report for EP 13878381.6, dated Oct. 21, 2016; EPO.

(Continued)

*Primary Examiner* — Dhirubhai R Patel
(74) *Attorney, Agent, or Firm* — Harness, Dickey & Pierce, P.L.C.

(57) ABSTRACT

A hermetic power terminal feed-through for use in high-pressure applications is disclosed as including a fused pin subassembly includes a tubular reinforcing member and a current-conducting pin. The pin passes through the tubular reinforcing member and is fixed thereto by a fusible sealing material to create a hermetic seal. The fused pin subassembly is then joined and hermetically sealed to a terminal body. A method for manufacturing the high-pressure hermetic power terminal feed-through is also disclosed.

23 Claims, 4 Drawing Sheets

(51) Int. Cl.

| | |
|---|---|
| ***F04B 39/12*** | (2006.01) |
| ***F04B 53/16*** | (2006.01) |
| ***H01R 43/16*** | (2006.01) |

(56) References Cited

U.S. PATENT DOCUMENTS

| | | | | |
|---|---|---|---|---|
| 4,841,101 | A | 6/1989 | Pollock | |
| 4,984,973 | A * | 1/1991 | Itameri-Kinter | H01B 17/305 174/152 GM |
| 5,017,740 | A * | 5/1991 | Honkomp | H01B 17/305 174/138 F |
| 5,227,587 | A | 7/1993 | Dieter | |
| 5,563,562 | A * | 10/1996 | Szwec | H01R 24/44 174/152 GM |
| 6,111,198 | A * | 8/2000 | Tower | H01L 21/50 174/135 |
| 6,841,731 | B1 | 1/2005 | Zanello | |
| 2008/0279703 | A1 | 11/2008 | Wang et al. | |
| 2013/0330599 | A1 | 12/2013 | Kroll et al. | |
| 2013/0330600 | A1 | 12/2013 | Goedeke et al. | |
| 2013/0330603 | A1 | 12/2013 | Kroll et al. | |
| 2013/0330604 | A1 | 12/2013 | Kroll et al. | |
| 2013/0330605 | A1 | 12/2013 | Kroll et al. | |
| 2013/0337316 | A1 | 12/2013 | Kroll et al. | |

FOREIGN PATENT DOCUMENTS

| | | | |
|---|---|---|---|
| JP | 52006178 | U1 | 1/1977 |
| JP | 54026084 | U1 | 2/1979 |
| JP | 2006143542 | | 6/2006 |
| WO | WO2012110242 | A1 | 8/2012 |
| WO | WO2012/167921 | | 12/2012 |

OTHER PUBLICATIONS

International Search Report and Written Opinion of the ISA, ISA/US, dated Mar. 10, 2014.

International Preliminary Report on Patentability, IPEA/US, dated Mar. 12, 2015.

* cited by examiner

HIGH-PRESSURE HERMETIC TERMINAL

CROSS-REFERENCE TO RELATED APPLICATIONS

This application is a 371 National Phase application of PCT/US2013/064788, filed on Oct. 14, 2013, which claims the benefit of U.S. Provisional Application No. 61/788,762, filed on Mar. 15, 2013. The entire disclosures of the above applications are incorporated herein by reference.

FIELD

The present disclosure generally relates to hermetic power terminal feed-throughs, and more particularly to hermetic power terminal feed-throughs for use in high-pressure applications.

BACKGROUND AND SUMMARY

This section provides background information related to the present disclosure which is not necessarily prior art.

Conventional, hermetically-sealed, electric power terminal feed-throughs (also referred to as "hermetic terminals") serve to provide an airtight electrical terminal for use in conjunction with hermetically sealed devices, such as air conditioning (A/C) compressors. In such applications, maintaining a hermetic seal is a critical requirement, and leakage through the hermetic terminal must be effectively precluded. FIG. 1 shows a schematic illustration of an A/C compressor 100 in which is installed a hermetic terminal 200 which enables electric power to be carried to a motor located within a sealed housing. The hermetic terminal is constructed to prevent the compressed, pressurized refrigerant gas 102 from escaping through the terminal 100.

An exemplary conventional hermetic terminal 200 that is well-known in the art is shown in FIG. 2. In such conventional hermetic terminals 200, an electrically conductive pin 202 is fixed in place within an aperture or opening 204 through a metal terminal body 206 by an electrically insulating fusible sealing glass 208 that forms a hermetic, glass-to-metal seal between the pin 202 and the terminal body 206. Optionally, a ceramic insulating sleeve 210 surrounds each pin 202 on the interior side of the terminal body 206 and is secured in place by the sealing glass 208. Additionally, a resilient electrical insulator 212 can optionally be bonded to the outside surface of the terminal body 206, as well as over the glass-to-metal seal 208 and portions of the current-conducting pins 202.

In a conventional hermetic terminal 200, the terminal body 206 is typically manufactured from cold rolled steel in a stamping operation that forms the cap-like shape of the terminal body 206, as well as the openings 204 through the top wall 214 of the terminal body. As a result of the stamping, the openings 204 through the top wall 214 of the terminal body 206 are formed to create a lip portion 216 that serves as a surface against which the fusible sealing glass 208 can create the hermetic seal. The surface area created by the lip portion 216, which has a length extending about two times or more the thickness of the top wall 214 of the terminal body 206, ensures that a sufficient seal can be made to achieve a desired hermeticity.

In addition to hermeticity, burst pressure is a critical performance specification for hermetic terminals, particularly those used in high-pressure applications. The performance requirements for high-pressure hermetic terminals often demand that the hermetic terminals be capable of maintaining hermeticity at pressures more than 20 MPa (i.e., several thousand pounds per square inch). In high-pressure air conditioning compressors, for example, hermetic terminals can be required to meet burst pressure ratings of 33 MPa (about 4800 psi). Any deformation of the terminal body under high pressure can compromise the integrity of the hermetic seal and result in failure of the hermetic terminal. Consequently, it is generally accepted that high-pressure hermetic terminals require a more robust (i.e., thicker) terminal body.

The dimensions of the hermetic terminal in combination with limitations in stamping technology, however, limit the maximum thickness of a terminal body that can be produced by a metal stamping process to only about 3.5 millimeters. Moreover, as the thickness of the material forming the terminal body increases toward 3.5 millimeters, the ability to form the lip portion in the opening (which provides the surface where hermetic seal can be made) during the stamping operation diminishes. Metal stamping has, therefore, been found to be unsuitable for forming a terminal body for a high-pressure hermetic terminal.

In order to achieve the necessary combination of hermeticity and burst pressure performance in high-pressure applications, then, high-pressure hermetic terminals generally incorporate a thicker terminal body. One exemplary high-pressure hermetic terminal 300 is illustrated in FIG. 3. As shown, the top wall 314 of the terminal body 306 is substantially thicker $t_2$ than the thickness $t_1$ of the top wall 206 of the conventional hermetic terminal 200 of FIG. 2, at least in part because of the need to provide adequate surface area for forming a sufficient hermetic seal. For example, a terminal body 306 having a top wall thickness $t_2$ of about 6 millimeters has been found to demonstrate the necessary strength under high pressure, while providing the surface area needed to enable the sealing glass 308 to form an adequate hermetic seal with the terminal body 306. The thicker terminal body 306, however, cannot readily be manufactured in a cost-effective manufacturing operation such as metal stamping. Instead, the thicker terminal bodies 306 are generally fabricated in the more costly manufacturing process of machining from bar stock. In addition, the bar stock from which the terminal bodies 306 are machined can include defects in the form of inclusions that can run vertically through the thickness $t_2$ of the top wall 314 of the machined terminal body 306. The inclusions can, in turn, lead to defects that increase the scrap rates of the machined parts.

Consequently, there remains a need for an improved high-pressure hermetic terminal that can meet the necessary combination of hermeticity and burst pressure performance in high-pressure applications and can be manufactured efficiently in a high-volume production environment, such as by stamping.

The present disclosure provides a hermetic power terminal feed-through for use in high-pressure applications. The hermetic power terminal can include a fused pin subassembly comprising a tubular reinforcing member and a current-conducting pin. The current-conducting pin passes through the tubular reinforcing member and can be fixed thereto by a fusible sealing material to create a hermetic seal. The fused pin subassembly can then be permanently joined and hermetically sealed to a terminal body by brazing or soldering.

The construction of the hermetic terminal of the present disclosure enables the terminal body to be made from a metal material that is thinner than the metal material conventionally employed in high-pressure hermetic terminals. Notwithstanding the thinner terminal body, the hermetic seal provided and the strength of the terminal body satisfy the performance demands of a high-pressure operating environment. The reduced thickness of the terminal body makes it suitable for forming in the economical manufacturing process of metal stamping.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a schematic view of a conventional A/C compressor incorporating a hermetic terminal power feed-through;

DETAILED DESCRIPTION

Figure 1:
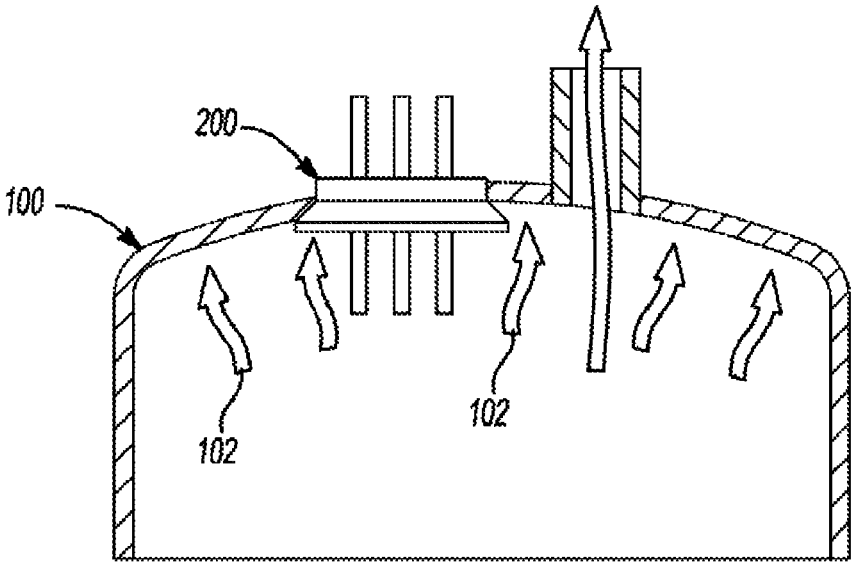
Figure 2:
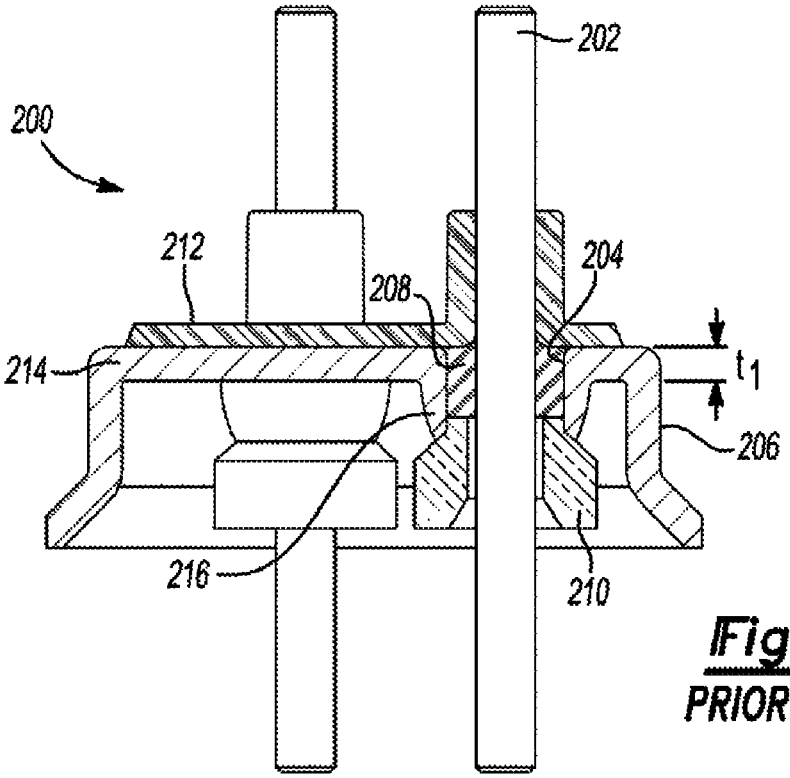
Fig-2 PRIOR ART
FIG. 2 is a cross-sectional front view of a conventional hermetic terminal.
Figure 3:
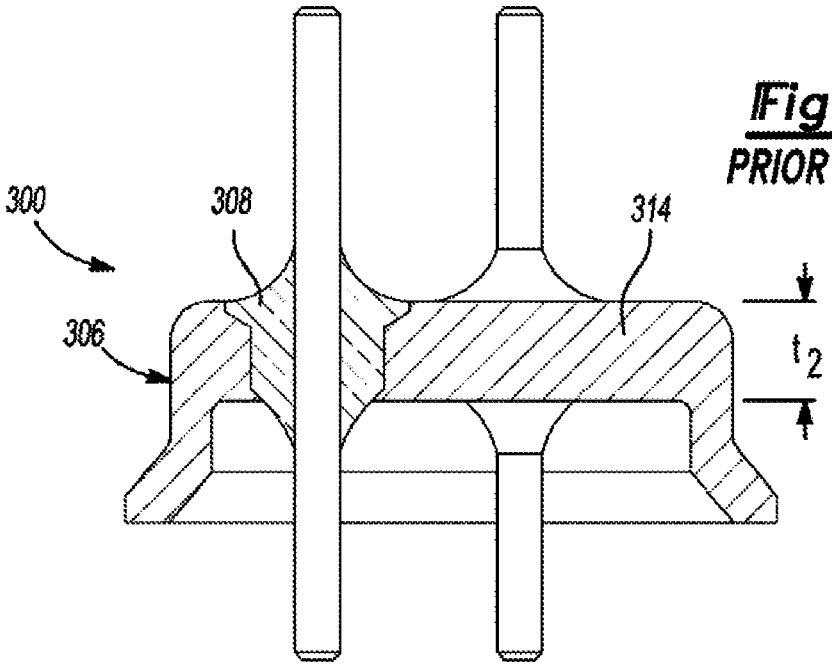
Fig-3 PRIOR ART
FIG. 3 is a cross-sectional front view of a conventional high-pressure hermetic terminal.

Example embodiments will now be described more fully with reference to the accompanying drawings.

Referring now to FIGS. 4-7, a hermetic terminal according to the teachings of the present disclosure is generally shown. The hermetic terminal 10 generally includes a terminal body 12, a reinforcing member 14, a current-conducting pin 16 and an electrically insulating fusible sealing material 18. The current-conducting pin 16 passes through and is fixed to the reinforcing member 14 by the fusible sealing material 18 that creates a hermetic seal between the pin 16 and the reinforcing member 14. The reinforcing member 14 is then permanently joined and hermetically sealed to a terminal body 12 by a joining process such as brazing or soldering. Of course, the hermetic terminal 10 can include a plurality of current-conducting pins 16, a plurality of reinforcing members 14 and a plurality of seals formed from the fusible sealing material 18.

Figure 4:
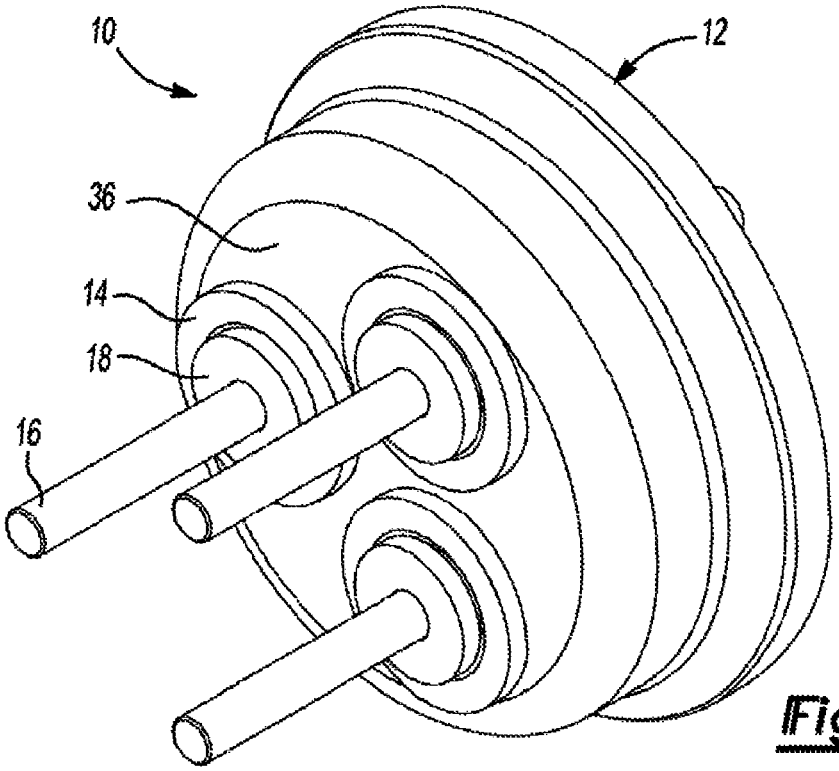
FIG. 4 is a perspective view of a high-pressure hermetic terminal of the present disclosure.
Figure 5:
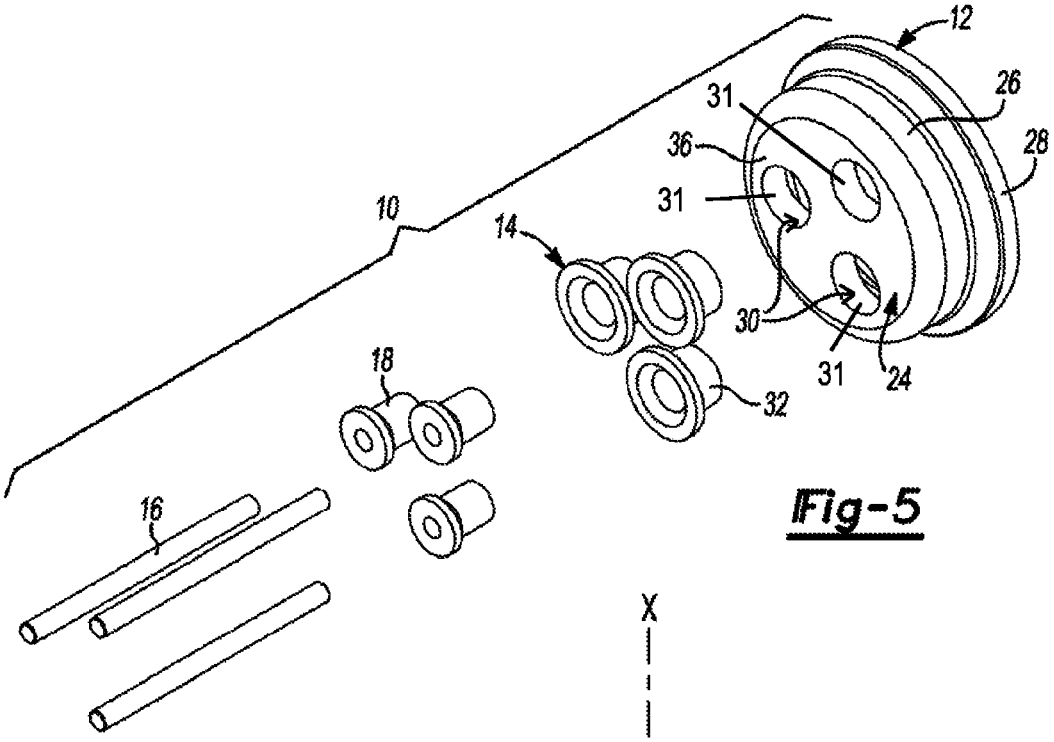
FIG. 5 is an exploded perspective view of the high-pressure hermetic terminal of FIG. 4.
Figure 6:
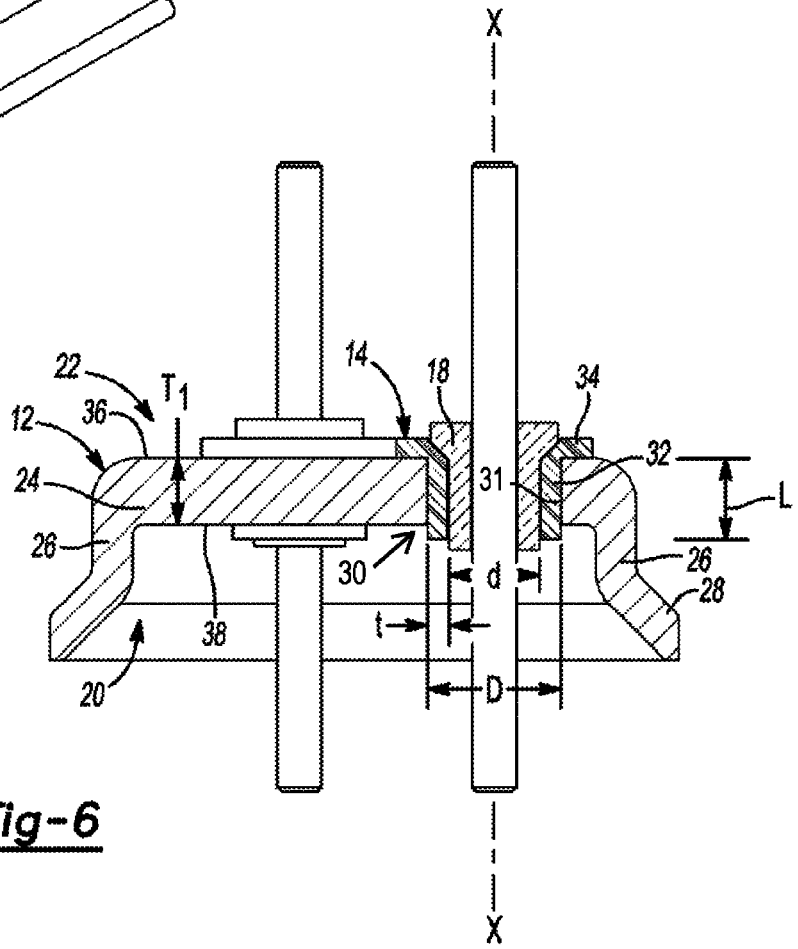
FIG. 6 is a cross-sectional front view of the high-pressure hermetic terminal of FIG. 4.

With reference to FIGS. 4 and 6, the exemplary hermetic terminal 10 is illustrated as having three current-conducting pins 16, each current-conducting pin 16 being hermetically sealed to a corresponding reinforcing member 14 which is, itself, hermetically joined to the terminal body 12. As shown, the current conducting pins 16 extend through the terminal body 12 from a first, interior side 20 of the terminal body 12 to a second, exterior side 22 of the terminal body 12.

The terminal body 12 comprises a metal, generally cap-shaped structure and includes a substantially planar top wall 24, a cylindrical sidewall 26, and an annular lip 28 extending radially and outwardly from the sidewall 26. The top wall 24 defines a plurality of openings 30, each having a side wall 31, for receiving the reinforcing members 14 and current-conducting pins 16, enabling the current-conducting pins 16 to pass through the terminal body 12.

The terminal body 12 can be about 25 to about 40 millimeters in diameter. The thickness (T1) of the top wall 24 can be less than about 3.5 millimeters, and is preferably between 2.5 millimeters and 3.5 millimeters, and more preferably between 3.0 millimeters and 3.5 millimeters. The terminal body 12 can be made from cold-rolled or hot-rolled steel in a metal stamping manufacturing process.

The reinforcing members 14 each comprise a body portion 32 having a hollow, tubular configuration extending for a length (L) along a longitudinal axis (X). The body portion 32 has a first, outer diameter, (D) a second, inner diameter (d) and a wall thickness (t). The outer diameter (D) is sized to closely fit within the opening 30 through the top wall 24 of the terminal body 12 such that the exterior surface of the body portion 32 is adjacent to the wall of the opening 30. The inner diameter (d) is sized to accommodate a current-conducting pin 16 passing through the reinforcing member 14 and the fusible sealing material 18 that creates the hermetic seal between the current-conducting pin 16 and the reinforcing member 14. The length (L) of the reinforcing member 14 is typically greater than the thickness (T1) of the upper wall 24 of the terminal body 12. In this configuration, the reinforcing member 14 provides for a seal surface along its inner diameter (d) that extends beyond the thickness (T1) of the upper wall 24 of the terminal body 12 and is, therefore, effective to create a hermetic seal with the fusible sealing material 18 and pin 16 that is suitable for use in a high-pressure operating environment.

Optionally, at one end of the tubular body portion 32, the reinforcing member 14 can include a flange or rim portion 34. Installed in the terminal body 12, the flange 34 can seat against the top wall 24 of the terminal body 12. For example, as shown in FIG. 6, the flange 34 of the reinforcing member 14 can seat against the exterior surface 36 of the top wall 24. Alternatively, the reinforcing member 14 can be installed in a manner such that the flange 34 seats against the interior surface 38 of the top wall 24. The flange 34 can aid in positioning the reinforcing member 14 relative to the terminal body 12 during the manufacture of the hermetic terminal 10. In addition, the flange 34 can serve as a structural reinforcement to the upper wall 24 of the terminal body 12, thereby increasing its resistance to deformation under the force generated in a high-pressure operating environment.

The reinforcing member 14 can be made from metal, such as cold rolled steel or hot rolled steel. The reinforcing member 14 can have a coefficient of thermal expansion that matches the coefficient of thermal expansion of the fusible sealing material 18, the current-conducting pin 16, and the terminal body 12.

Each current conducting pin 16 extends along the longitudinal axis (X) and is received within the reinforcing member 14. The current-conducting pin 16 is fixed in place relative to the reinforcing member 14 by the fusible sealing material 18. The current conducting pin 16 is preferably made from steel, stainless steel, or a copper-cored steel wire. The current conducting pin 16 can have a coefficient of thermal expansion that matches the coefficient of thermal expansion of the fusible sealing material 18, the reinforcing member 14, and the terminal body 12.

The fusible sealing material 18 can comprise a fusible glass for creating a hermetic, glass-to-metal seal between the current-conducting pin 16 and the reinforcing member 14. Such materials are well-known in the field. The fusible sealing material 18 can have a coefficient of thermal expansion that matches the coefficient of thermal expansion of the reinforcing member 14, the current-conducting pin 16, and the terminal body 12.

A significant advantage to the construction of the hermetic terminal 10 of the present disclosure is that a thinner terminal body 12 than is conventionally employed in a high-pressure hermetic terminal can be used in the hermetic terminal 10 of the present disclosure. Notwithstanding that its thinner, the hermetic seal provided and the strength of the terminal body 12 satisfy the performance demands of a high-pressure operating environment. Further, the reduced thickness of the terminal body 12 makes it suitable for forming the cap-shaped terminal body having one or more openings through the top wall in the more economical manufacturing process of metal stamping, as opposed to machining from bar stock as has been done previously. The metal stamping process can employ less expensive tools that can run at higher production speeds, thereby reducing manufacturing costs and increasing manufacturing output. Still further, terminal bodies formed in a metal stamping process generally do not exhibit the defects in the form of inclusions that can run vertically through the thickness of the top wall as in a machined terminal body.

The process for manufacturing the hermetic terminal 10 of the present disclosure differs from that of prior hermetic terminal devices. In one respect, the current-conducting pin 16 can be hermetically joined to the reinforcing member 14 by the fusible sealing material 18 to create a fused pin subassembly, prior to its assembly with the terminal body 12. First, the fusible sealing material 18 can be configured as a preformed tube. The pin 16, preformed tube 18, and reinforcing component 14 can then be arranged such that the preformed tube 18 is nested within the reinforcing component 14 and the pin 16 passes through the preformed tube 18 and reinforcing member 14. Thereafter, the arrangement is heated to the fusing temperature of the electrically insulating fusible sealing material 18 (i.e., about 1500° F. for fusible sealing glass). After heating, the assembly can then be cooled thereby creating the fused pin subassembly, with the pin 16 and reinforcing member 14 being joined by a hermetic seal created by the fusible sealing material 18.

Thereafter, the fused pin subassembly can be installed in the terminal body 12 through the opening 30 in the top wall 24. Once positioned within the opening 30, the fused pin subassembly can be joined to the terminal body 12 by a joining process like brazing or soldering. The joining process provides a filler material that occupies the closely fitting space between the fused pin subassembly (e.g., the outer diameter (D) of the reinforcing member (14) and the opening 30) and adheres to both the reinforcing member 14 and the terminal body 12. The joining process creates a hermetic seal 39 between the fused pin subassembly and the terminal body 12. The hermetic seal can extend between the reinforcing member 14 and the opening 30 along the entire axial length of the opening 30 (i.e., the thickness of the top wall 24). Additionally, the hermetic seal 39 can extend between the flange 34 of the reinforcing member 14 (if a flange 34 forms part of the reinforcing member 14) and the exterior surface 36 (or interior surface 38—depending on the orientation of the reinforcing member 14 in the opening 30) of the top wall 24 of the terminal body 12. This joining process generally can occur at a much lower temperature (e.g., about 840° F.) than the fusing temperature of the electrically insulating fusible sealing material and, therefore, the integrity of the hermetic seal between the pin 16 and reinforcing member 14 is not affected by the process.

Figure 7:
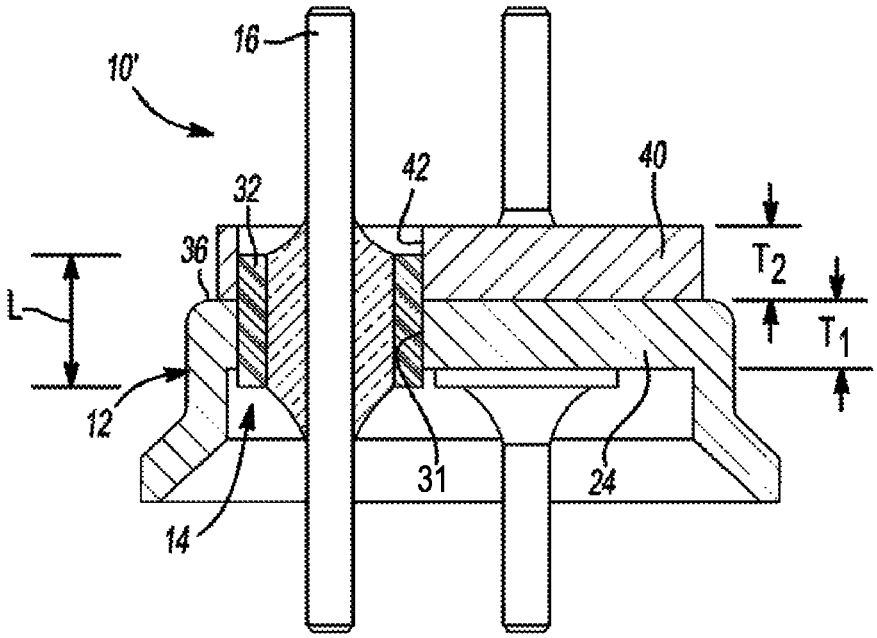
FIG. 7 is a cross-sectional front view of an alternative embodiment of the high-pressure hermetic terminal of the present disclosure.
Figure 8:
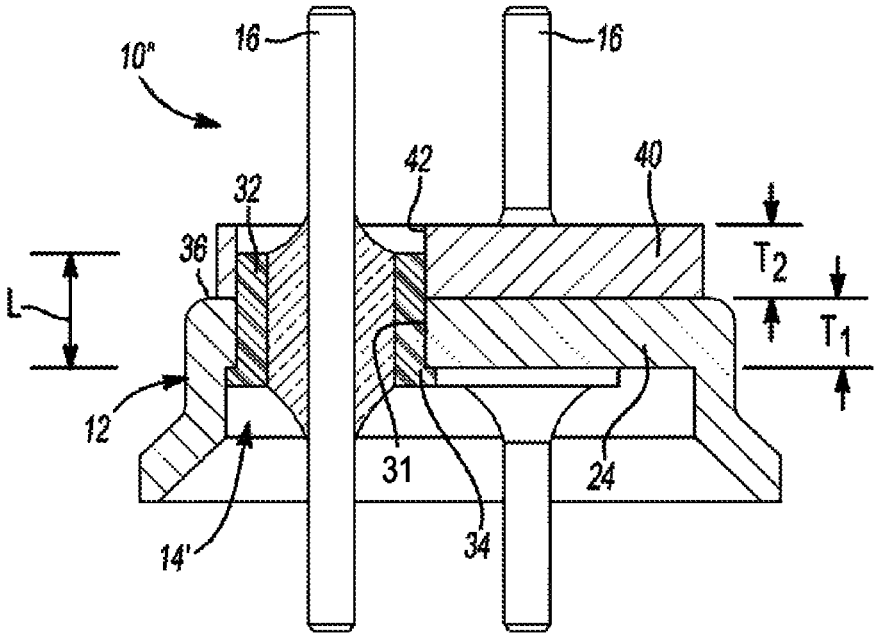
FIG. 8 is a cross-sectional front view of still another alternative embodiment of the high-pressure hermetic terminal of the present disclosure.

Additional alternatives for the high-pressure hermetic terminal of the present disclosure 10' and 10" are shown in FIGS. 7 and 8. In the hermetic terminal 10' shown in FIG. 7, a rigid pad 40 can be attached to the exterior surface 36 of the top wall 24 of the terminal body 12, either before or after the fused pin subassembly is joined to the terminal body 12. The rigid pad 40 can be generally disc-shaped and sized to substantially cover the exterior surface 35 of the top wall 24 of the terminal body 12. The rigid pad 40 can include one or more apertures 42 that are substantially aligned with the opening(s) 30 in the top wall 24 of the terminal body 12 for enabling the current-conducting pin(s) 16 to pass through the pad 40. The rigid pad 40 can have a thickness (T2) of less than or about the same thickness (T1) of the top wall 24 of the terminal body 12. Preferably, the combined thickness (T1+T2) of the top wall 24 and the rigid pad 40 is slightly greater than the length (L) of the reinforcing member 14.

The rigid pad 40 can provide additional structural support to the terminal body 12 further adapting the hermetic terminal 10' for use in high-pressure applications. As shown in FIGS. 7 and 8, the pad 40 can be employed in addition to a reinforcing member 14, 14' (independent of whether or not the reinforcing member incorporates a flange 34). The pad 40 can be made from the same metal as the terminal body 12 and can be joined to the terminal body 12 by a joining process as previously described, such as by brazing or soldering.

Moreover, while not illustrated, it is understood that the power terminal feed-throughs according to the present disclosure may also incorporate additional features such as a protective oversurface coating (e.g., silicone rubber) on the terminal body, fuse portions integrated into the pins, additional insulators providing oversurface protection for the pins (e.g., ceramic insulators), and connectors adapted to connect the pins to other components.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A high-pressure hermetic terminal for use in high-pressure A/C compressors comprising: a cap-shaped, metal body comprising a generally planar top wall and a cylindrical first side wall, the top wall comprising a thickness of 2.5 millimeters to 3.5 millimeters and having an opening extending therethrough in the direction of a longitudinal axis, the opening comprising a wall having a length equal to the thickness of the top wall; a metal, tubular reinforcing member located within the opening and extending along the longitudinal axis, an outer diameter of the reinforcing member being sized to closely fit within the opening such that an exterior surface of the reinforcing member is adjacent to a wall of the opening, the reinforcing member being joined to the body by a filler metal: a current-conducting pin extending through the reinforcing member along the longitudinal axis; and an electrically insulating fusible sealing material joining and hermetically sealing the current-conducting pin to the reinforcing member; wherein the high-pressure hermetic terminal maintains hermeticity at pressures more than 20 Megapascals and burst resistance at pressures of 33 Megapascals.

2. The hermetic terminal of claim 1 wherein the reinforcing member has a length in the direction of the longitudinal axis that is greater than the thickness of the top wall.

3. The hermetic terminal of claim 1 wherein the reinforcing member comprises a body portion and a rim portion located at one end of the body portion.

4. The hermetic terminal of claim 3 wherein the rim portion seats against the top wall of the terminal body.

5. The hermetic terminal of claim 4 wherein the rim portion seats against an exterior side of the top wall of the terminal body.

6. The hermetic terminal of claim 4 wherein the rim portion seats against an interior side of the top wall of the terminal body.

7. The hermetic terminal of claim 1 further comprising a rigid metal pad attached to the exterior side of the top wall of the terminal body.

8. The hermetic terminal of claim 7 wherein the pad is sized to cover the exterior side of the top wall of the terminal body and comprises an aperture that is aligned with the opening in the top wall of the terminal body in the direction along the longitudinal axis.

9. The hermetic terminal of claim 8 wherein the combined thickness of the pad and the top wall of the terminal body is greater than a length of the reinforcing member.

10. A method for manufacturing a high-pressure hermetic terminal for use in high-pressure A/C compressors comprising: forming a cap-shaped, metal body in a stamping operation, wherein the body comprises a generally planar top wall and a cylindrical side wall, and wherein the top wall has a thickness of 2.5 millimeters to 3.5 millimeters and comprises at least one opening therethrough extending along a longitudinal axis; providing a metal, tubular reinforcing member comprising a body having a first outer diameter sized to closely fit within the opening such that an exterior surface of the reinforcing member is adjacent to a wall of the opening and a first inner diameter; providing an electrically insulating fusible sealing material configured as a preformed tube having a second outer diameter that is sized to fit within the first inner diameter of the reinforcing member and a second inner diameter; providing a current-conducting pin having a third outer diameter sized to fit within the second inner diameter of the preformed tube; placing the sealing material within the reinforcing member; placing the pin within the sealing material; permanently joining the pin to the reinforcing member to form a fused pin subassembly; placing the fused pin subassembly within the opening; and permanently joining the fused pin subassembly to the body, wherein the high-pressure hermetic terminal maintains hermeticity at pressures more than 20 Megapascals and burst resistance at pressures of 33 Megapascals.

11. The method for manufacturing a high-pressure hermetic terminal of claim 10, wherein permanently joining the pin to the reinforcing member comprises creating a hermetic seal between the reinforcing member and the pin; and wherein permanently joining the fused pin subassembly to the body comprises creating a hermetic seal between the reinforcing member and the body.

12. The method for manufacturing a high-pressure hermetic terminal of claim 11, wherein creating a hermetic seal between the reinforcing member and the pin comprises heating the pin, sealing material and reinforcing member to the fusing temperature of the sealing material.

13. The method for manufacturing a high-pressure hermetic terminal of claim 12, wherein heating the pin, sealing material and reinforcing member to the fusing temperature of the sealing material comprises heating to about 1500° F.

14. The method for manufacturing a high-pressure hermetic terminal of claim 13, wherein permanently joining the fused pin subassembly to the body comprises heating a filler material to about 840° F.

15. The method for manufacturing a high-pressure hermetic terminal of claim 10, wherein providing a metal, tubular reinforcing member further comprises providing a metal reinforcing member comprising a body having a rim portion located at one end; and wherein placing the fused pin subassembly within the opening comprises orienting the fused pin subassembly within the opening such that the rim portion seats against an exterior side of the top wall.

16. The method for manufacturing a high-pressure hermetic terminal of claim 10, wherein providing a metal, tubular reinforcing member further comprises providing a metal reinforcing member comprising a body having a rim portion located at one end; and wherein placing the fused pin subassembly within the opening comprises orienting the fused pin subassembly within the opening such that the rim portion seats against an interior side of the top wall.

17. The method for manufacturing a high-pressure hermetic terminal of claim 10, wherein permanently joining the fused pin subassembly to the body comprises heating a filler material to about 840° F.

18. A high-pressure hermetic terminal for use in high-pressure A/C compressors comprising: a cap-shaped, metal body comprising a generally planar top wall and a cylindrical first side wall, the top wall comprising a first thickness of between 2.5 millimeters and 3.5 millimeters and having an opening extending therethrough along a longitudinal axis, the opening comprising a second side wall having a length equal to the thickness of the top wall in the direction of the longitudinal axis: a metal, tubular reinforcing member located within the opening and joined to the body, and having an outer diameter sized to closely fit within the opening; a current-conducting pin extending through the reinforcing member along the longitudinal axis; an electrically insulating fusible sealing material joining and hermetically sealing the current-conducting pin to the reinforcing member; and a rigid metal pad attached to an exterior side of the top wall, the pad comprising an aperture that is aligned with the opening, the pad providing structural support to the body; wherein the high-pressure hermetic terminal maintains hermeticity at pressures more than 20 Megapascals and burst resistance at pressures at pressures of 33 Megapascals.

19. The hermetic terminal of claim 18 wherein the pad covers the exterior side of the top wall and has a second thickness about the same as the first thickness.

20. The hermetic terminal of claim 19 wherein the reinforcing member comprises a body portion and a rim portion located at one end of the body portion.

21. The hermetic terminal of claim 20 wherein the rim portion seats against the top wall of the terminal body.

22. The hermetic terminal of claim 21 wherein the rim portion seats against an interior side of the top wall of the terminal body.

23. The hermetic terminal of claim 18 wherein the pad covers the exterior side of the top wall and has a second thickness about the same as the first thickness.

* * * * *